US007708621B2

(12) United States Patent
Saito

(10) Patent No.: US 7,708,621 B2
(45) Date of Patent: May 4, 2010

(54) POLISHING APPARATUS AND METHOD OF RECONDITIONING POLISHING PAD

(75) Inventor: Toshiya Saito, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 5 days.

(21) Appl. No.: 12/051,156

(22) Filed: Mar. 19, 2008

(65) Prior Publication Data

US 2008/0242199 A1 Oct. 2, 2008

(30) Foreign Application Priority Data

Mar. 30, 2007 (JP) ..... 2007-094472

(51) Int. Cl.
*B24B 1/00* (2006.01)

(52) U.S. Cl. ..... 451/53; 451/285; 451/443

(58) Field of Classification Search ..... 451/53, 451/285–290, 443
See application file for complete search history.

(56) References Cited

U.S. PATENT DOCUMENTS 5,707,274 A * 1/1998 Kim et al. ..... 451/285
5,941,762 A * 8/1999 Ravkin et al. ..... 451/56
5,990,010 A * 11/1999 Berman ..... 438/691
6,152,813 A * 11/2000 Suzuki ..... 451/443
6,390,902 B1 * 5/2002 Chang et al. ..... 451/285
6,935,938 B1 * 8/2005 Gotkis et al. ..... 451/443
6,939,208 B2 * 9/2005 Kamimura et al. ..... 451/56
6,976,907 B2 * 12/2005 Golzarian et al. ..... 451/56
7,040,968 B2 * 5/2006 Kamimura et al. ..... 451/56
7,207,864 B2 * 4/2007 Kamimura et al. ..... 451/5
2002/0065029 A1 * 5/2002 Huang et al. ..... 451/72
2004/0102045 A1 * 5/2004 Chopra et al. ..... 438/689
2007/0066189 A1 * 3/2007 Lujan ..... 451/56

FOREIGN PATENT DOCUMENTS

JP 11-048122 2/1999

* cited by examiner

*Primary Examiner*—Maurina Rachuba
(74) *Attorney, Agent, or Firm*—Young & Thompson

(57) ABSTRACT

This polishing apparatus includes a head that holds a semiconductor wafer, a polishing pad that polishes a surface to be polished of the semiconductor wafer held by the head, and a dresser that reconditions the polishing pad by cutting the polishing pad. The polishing apparatus polishes a surface to be polished of the semiconductor wafer while causing the head and the polishing pad to rotate and reconditions the polishing pad by use of the dresser before and after polishing the surface to be polished. The polishing apparatus of the present invention supports at least two dressers so that the dressers can rotate on their own axes and further includes a dresser oscillator that causes the dressers to oscillate simultaneously on the polishing pad.

6 Claims, 4 Drawing Sheets

POLISHING APPARATUS AND METHOD OF RECONDITIONING POLISHING PAD

This application is based upon and claims the benefit of priority from Japanese patent application No. 2007-094472, filed on Mar. 30, 2007, the disclosure of which is incorporated herein in its entirety by reference.

BACKGROUND OF THE INVENTION

1. Field of the Invention

The present invention relates to a CMP (chemical mechanical polishing) apparatus that polishes wafers in the manufacturing process of semiconductor devices, and a dresser that reconditions a polishing pad provided in a CMP apparatus.

2. Description of the Related Art

The surface of a polishing pad is worn down during wafer polishing in the CMP process and, therefore, it is inevitable to perform reconditioning by the use of a dresser. Under the present circumstances, one dresser is arranged for one polishing pad and reconditioning is performed by causing the polishing pad and the dresser to rotate on their own axes.

FIG. 1 is a sectional view of a CMP apparatus of a related art in which one dresser is arranged, and FIG. 2 is a plan view of FIG. 1. As shown in these figures, the CMP apparatus has polishing head 1 that produces a polishing action by pushing the surface of wafer 2 against polishing pad 5. Polishing head 1 is provided with retainer ring 3 that holds wafer 2 that is being polished and is provided with membrane 4 that applies pressure to a rear surface of wafer 2 that is being polished. In order to ensure that the whole surface of semiconductor wafer 2 is evenly depressed onto the surface of polishing pad 5, polishing head 1 is also provided with periphery pressurizing portion 6 that pressurizes the periphery of wafer 2. During polishing, a rotational motion is given to polishing head 1, and also polishing pad 5 is rotatably driven around a center portion of the polishing pad.

A slurry supply port 7 that supplies slurry (an abrasive) is present on the polishing pad 5 and a dresser 8 that reconditions the polishing pad 5 is also arranged thereon.

To recondition polishing pad 5, this dresser 8 oscillates on polishing pad 5 in the range of the radius of polishing pad 5 while rotating on its own axis as shown in FIG. 2, thereby performing the cutting of polishing pad 5. For this reason, the reconditioning time becomes long in proportion to the size of polishing pad 5 and the dresser life relative to the number of treated wafers decreases.

To extend the life of a polishing pad and stabilize the polishing rate, Japanese laid-open patent publication No. 11-48122 proposes a technique for using two kinds of dressers for one polishing pad as a related art.

However, conventional CMP apparatus have had the following problems.

The dresser reconditions the polishing pad by cutting the polishing pad while oscillating within the radius of the polishing pad in the spare time when the wafer is being conveyed before and after polishing. For this reason, the larger the diameter of the polishing pad, the longer the required reconditioning time will be, and the throughput of the CMP apparatus will decrease by just that much.

Also, when a dresser is used, the edge of diamond abrasive grains fixed to a bottom surface of the dresser becomes dull and the cutting capacity of the polishing pad decreases. When the polishing pad diameter increases, the cutting time becomes long and, therefore, the cumulative number of treated wafers per dresser decreases. Furthermore, it is necessary that dresser replacement be performed in accordance with the procedure of replacement work, simulation polishing and checking the polishing rate/uniformity of polishing/dust/scratches and the like, and the apparatus comes to a stop for about 4 hours once the replacement is made. Therefore, it follows that the apparatus stop time (downtime) also increases with increasing frequency of dresser replacement.

SUMMARY OF THE INVENTION

In view of the circumstances of the above-described related art, an object of the present invention is to enables the throughput of a CMP apparatus to be improved and the downtime of the CMP apparatus to be reduced.

A polishing apparatus in an aspect of the present invention includes a head that holds a semiconductor wafer, a polishing pad that polishes a surface to be polished of the semiconductor wafer held by the head, and a dresser that reconditions the polishing pad by cutting the polishing pad. The polishing apparatus polishes a surface to be polished of the semiconductor wafer, and reconditions the polishing pad while causing the head and the polishing pad to rotate and reconditions the polishing pad by use of the dresser before and after polishing the surface to be polished.

In this aspect, because the polishing apparatus supports at least two dressers and further includes a dresser oscillator that causes the dressers to oscillate simultaneously on the polishing pad, it is possible to solve the above-described problems with the conventional polishing apparatus. That is, because the polishing pad cutting time can be shortened compared to the case where one dresser is used, it is possible to suppress a decrease in the throughput of the CMP apparatus when the polishing pad diameter increases to match an increase in the wafer diameter, as well as an increase in downtime.

When the construction is such that the dresser oscillator separately supports each of the dressers, it is necessary to have a dresser position controller that controls the position of each of the dressers so that oscillations of each of the dressers are in synchronization with each other.

When the polishing pad is reconditioned by the dresser before and after the polishing of a wafer surface to be polished by use of such a polishing apparatus as described above, it is preferred that at least two dressers are simultaneously moved onto the polishing pad, that each of the dressers be caused to rotate on its own axis, and that the dressers be caused to oscillate simultaneously on the polishing pad. It is preferred that at this time oscillations of each of the dressers be caused to be in synchronization with each other.

Incidentally, in the technique disclosed in Japanese laid-open patent publication No. 11-48122, after cutting the surface of a polishing pad by using a first dresser in which diamond abrasive grains are fixed to a bottom surface, the first dresser is moved backward and subsequently the truing of the polishing pad surface is performed by use of the second dresser formed from a polymer fiber brush simultaneously with polishing the wafer surface by the polishing pad. That is, this technique is intended for simultaneously solving the problem in which the life of the polishing pad decreases when cutting by the first dresser is performed during wafer polishing, and the problem in which the polishing rate decreases unless the polishing pad surface is trued during polishing, and this technique is not a technique by which two dressers are used for the polishing pad before and after polishing or during polishing. Also, the shortening of the polishing pad cutting time by use of the first dresser is not aimed at in the least.

The above and other objects, features and advantages of the present invention will become apparent from the following description with reference to the accompanying drawings which illustrate examples of the present invention.

DETAILED DESCRIPTION OF THE EXEMPLARY EMBODIMENT

Figure 1:
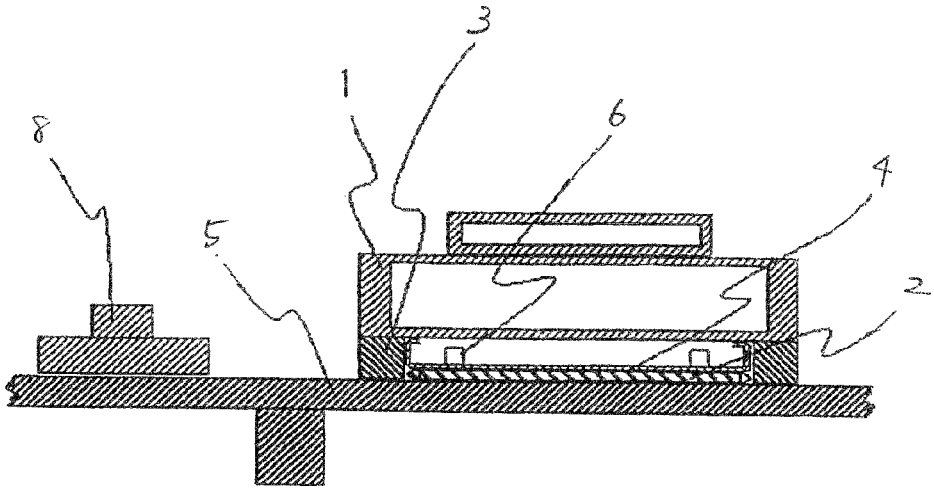
Fig. 1 Prior Art
FIG. 1 is a sectional view of a CMP apparatus of a related art.
Figure 2:
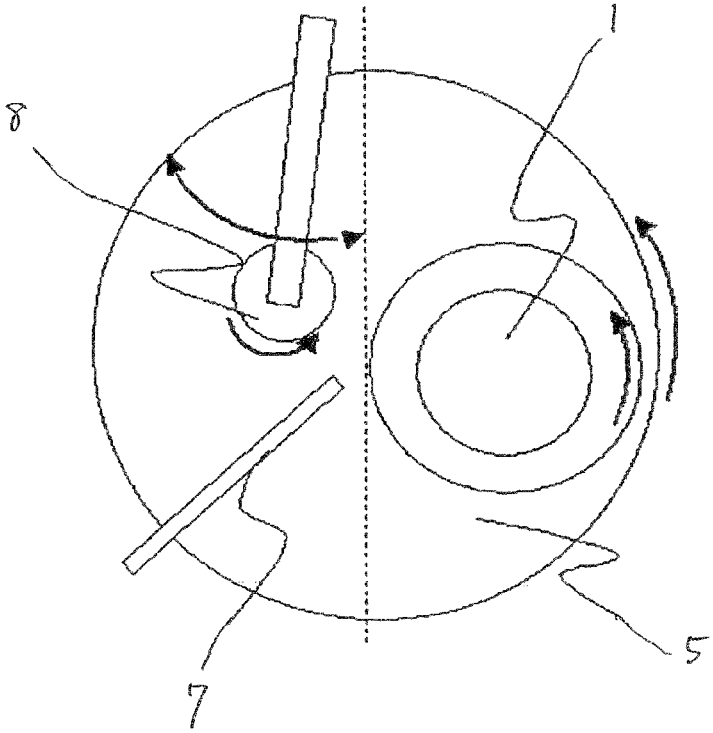
Fig. 2 Prior Art
FIG. 2 is a plan view of the apparatus shown in FIG. 1.
Figure 3:
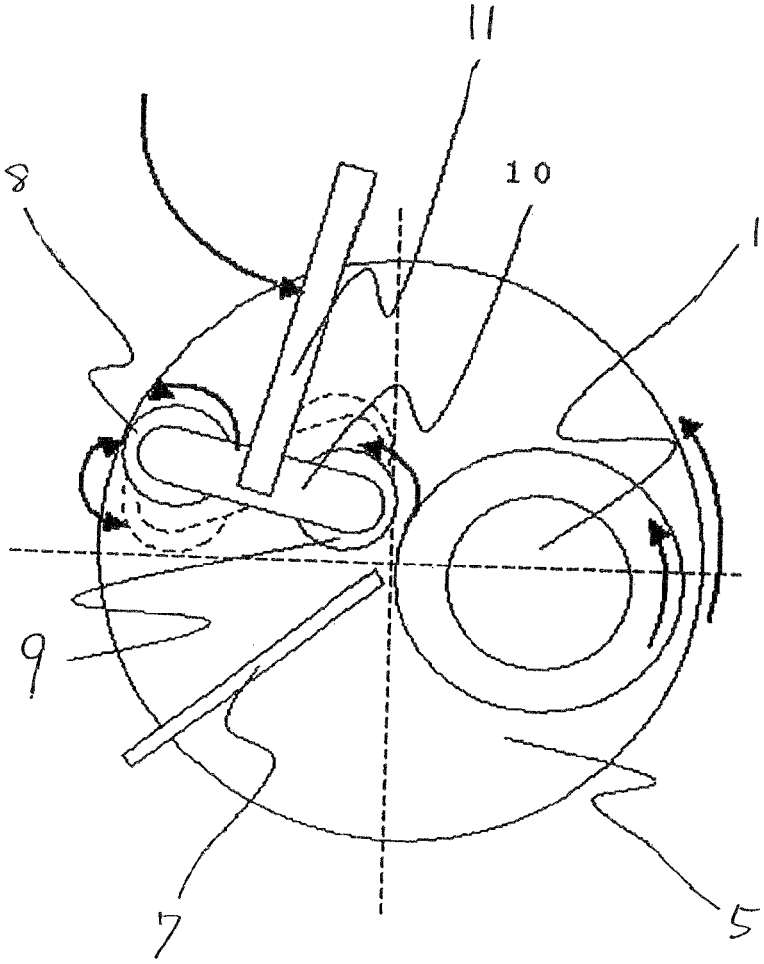
FIG. 3 is a plan view of an oxide film CMP apparatus showing mainly a polishing head and a dresser in an exemplary embodiment of the present invention.
Figure 4:
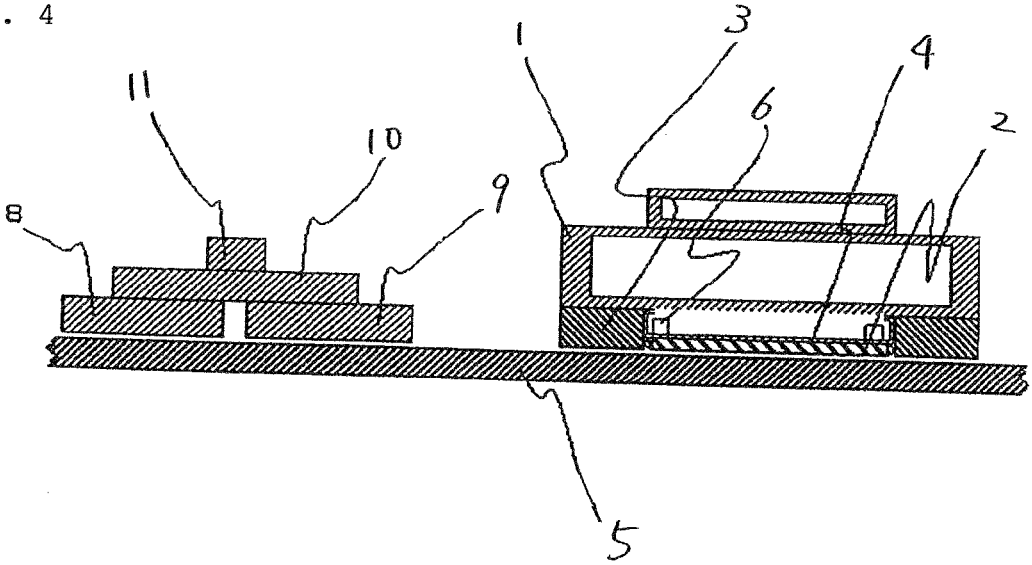
FIG. 4 is a sectional view of the apparatus of FIG. 3.

FIG. 3 is a plan view of an oxide film CMP apparatus showing mainly a polishing head and a dresser in an exemplary embodiment of the present invention, and FIG. 4 shows a sectional view of the apparatus of FIG. 3. Incidentally, in these figures, parts having the same functions as parts of the CMP apparatus of the related art are identified by the same reference numerals as shown in FIGS. 1 and 2.

As shown in FIGS. 3 and 4, the CMP apparatus of this exemplary embodiment has polishing head 1, polishing pad 5, and at least two dressers 8, 9.

Polishing head 1 arranged on polishing pad 5 is formed from a metal casing, and retainer ring 3 made of polyphenylene sulfide (hereinafter abbreviated as PPS) or polyetheretherketone (hereinafter abbreviated as PEEK) is attached to the periphery of a bottom surface of polishing head 1. On the inner side of retainer ring 3 on the bottom surface of polishing head 1, there are disposed membrane 4 made of neoprene rubber, which corresponds to the whole surface of wafer 2, and periphery pressurizing portion 6 made of a polymer material, which corresponds to the periphery of wafer 2.

In addition, upon polishing pad 5, it is possible to arrange first dresser 8 and second dresser 9, in which diamond abrasive grains are fixed to a bottom surface. Two dressers 8, 9 are each rotatably supported in both end portions of elongated dresser supporting plate 10. Furthermore, dresser oscillating plate 11 rotatably supports a middle part between dressers 8, 9 of dresser supporting plate 10. By use of this dresser oscillating plate 11, it is possible to move dressers 8, 9 onto polishing pad 5 and to cause dressers 8, 9 to oscillate simultaneously by the reciprocal rotational motions of dresser supporting plate 10 on polishing pad 5. Incidentally, the size of dressers 8, 9 and the range of the reciprocal rotation of dresser supporting plate 10 are to be determined beforehand so that dressers 8, 9 can oscillate in the range of the radius in polishing pad 5.

In the above-described CMP apparatus, first dresser 8 and second dresser 9 cut the surface of polishing pad 5 by oscillating at a pressure of 20 N in the range of the radius of polishing pad 5 for a given time while rotating in the same direction at a speed of 40 $min^{-1}$ (FIG. 3).

Next, silica-based slurry is discharged at 300 ml/min from slurry supply port 7 to the middle part of polishing pad 5 made of polyurethane, and polishing pad 5 rotates on its own axis at a rotation speed of 30 $min^{-1}$ in a fixed direction, whereby the discharged slurry diffuses over the whole area on polishing pad 5. Wafer 2 is adsorbed onto polishing head 1 in a face down position and is conveyed onto polishing pad 5.

Polishing head 1 rotates on its own axis at a rotation speed of 29 $min^{-1}$ and is pushed against polishing pad 5 that is rotating at a rotation speed of 30 $min^{-1}$ in a given direction at a mechanical pressure (called the F1 pressure) of 70 N while oscillating in the area of the radius in polishing pad 5. After that, wafer 2 is pressurized against polishing pad 5 at a pressure of 50 N (called the F2 pressure) by high-pressure air supplied to an air chamber isolated by membrane 4 within polishing head 1. Although the polishing rate at this time is proportional to the F2 pressure at which wafer 2 is pushed against polishing pad 5, the within-wafer uniformity of the polishing rate tends to worsen in wafer edge portions. For this reason, periphery pressurizing portion 6 is provided. Periphery pressurizing portion 6 is a ring-shaped tube arranged just above a peripheral portion of the wafer on the inner side of membrane 4 and ensures that the wafer edge portion obtains a desired polished profile by pressurizing only the peripheral portion of the wafer through the adjustment of the high air pressure (called the F3 pressure) introduced into the tube in the range of 50±5 N or so.

Wafer 2 polished in this state is cleaned after a given time, which has been determined beforehand, and recovered, and next wafer 2 is similarly polished.

Before the polishing of next wafer 2, as described above, it is necessary to recondition polishing pad 5 by cutting the surface of polishing pad 5 by using first dresser 8 and second dresser 9.

Figure 5:
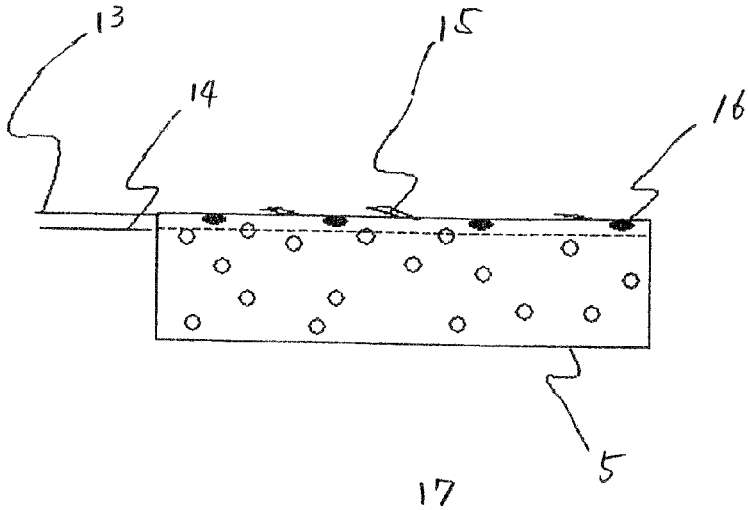
FIG. 5 is a sectional view of a polishing pad before cutting by a dresser.
Figure 6:
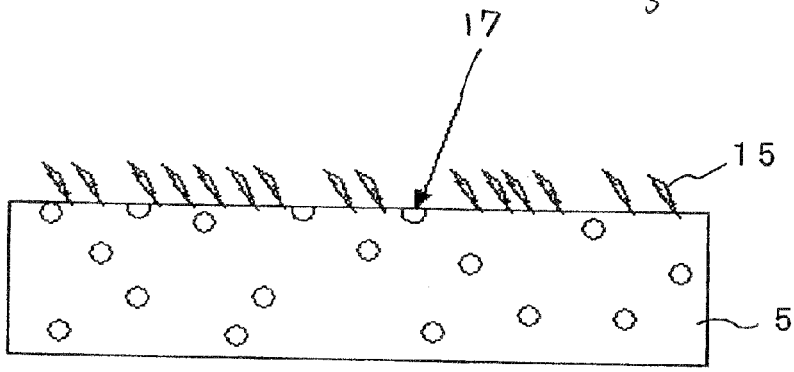
FIG. 6 is an ideal sectional view of the polishing pad shown in FIG. 5 after cutting by the dresser.

FIG. 5 shows a sectional view of polishing pad 5 before the cutting by a dresser, and FIG. 6 shows an ideal sectional view of the polishing pad shown in FIG. 5 after cutting by the dresser.

When polishing pad 5 is cut by using first dresser 8 and second dresser 9, as shown in FIG. 5, polishing pad 5 is cut from cutting start surface 13 to cutting completion surface 14 and dust-clogged pores 16 are cut off. As a result of this, as shown in FIG. 6, pores free from dust 17 are exposed to the surface. On this occasion, fluff 15 is formed on the top surface of polishing pad 5. The more erect that fluff 15 is on polishing pad 5, the more easily will the slurry be held, with the result that the polishing rate can be maintained. Incidentally, "fluff" is cuttings of the polishing pad that remain on the top surface in an unseparated condition.

Figure 7:
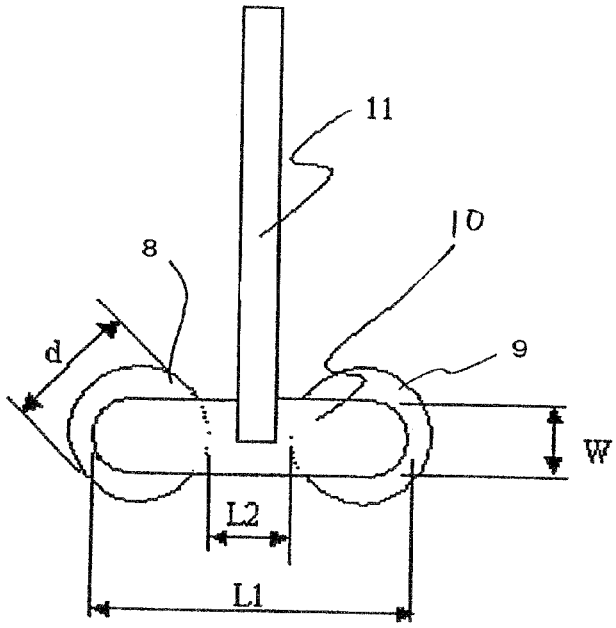
FIG. 7 is a plan view showing mainly a dresser supporting plate and a dresser oscillating plate shown in FIGS. 3 and 4.

FIG. 7 is a plan view showing mainly dresser supporting plate 10 and dresser oscillating plate 11 shown in FIGS. 3 and 4.

As shown in FIG. 7, two dressers 8, 9 of the same kind in which diamond abrasive grains are fixed to a bottom surface, are attached to dresser supporting plate 10 so that each of the dressers can rotate on its own axis, and also dresser supporting plate 10 is attached to dresser oscillating plate 11 so as to be rotatable. In this state dresser oscillating plate 11 moves dresser supporting plate 10 onto polishing pad 5 and thereafter two dressers 8, 9 are caused to rotate on their own axes simultaneously in the same direction. Furthermore, in order to cause two dressers 8, 9 rotating on their own axes to oscillate simultaneously on polishing pad 5 that is rotating in one direction, dresser supporting plate 10 is caused to perform reciprocal rotational motions through 45 degrees or so. As a result of this, polishing pad 5 is cut. The sizes of each part in FIG. 7 are as follows: d=110±5 mm, W=80±10 mm, L1=220±10 mm, L2=30±5 mm or so.

As described above, in the present invention, two cutting-type dressers 8, 9 are simultaneously arranged for one polishing pad, each of dressers 8, 9 is caused to rotate on its own axis, and two dressers 8, 9 are caused to oscillate at the same time. For this reason, it is possible to shorten the polishing pad cutting time compared to the case of one dresser. This becomes a technique effective in permitting an improvement of the throughput of the CMP apparatus and a reduction of downtime against the background in which the polishing pad diameter also increases with increasing wafer diameter, resulting in a longer reconditioning time with one dresser.

That is, the following effects are obtained by simultaneously using two dressers 8, 9 on one polishing pad 5.

Because a treatment area that has hitherto been cut by one dresser 8 is shared by two dressers 8, 9, it is possible to shorten the reconditioning time compared to the reconditioning performed by use of one dresser 8. As a result of this, it is possible to improve the throughput of the CMP apparatus.

Furthermore, because the reconditioning time becomes short compared to the case of one dresser, the dresser life for the number of wafers treated is extended, with the result that the frequency of dresser replacement decreases and hence it is possible to reduce the apparatus stop time (downtime).

Another Exemplary Embodiment

Figure 8:
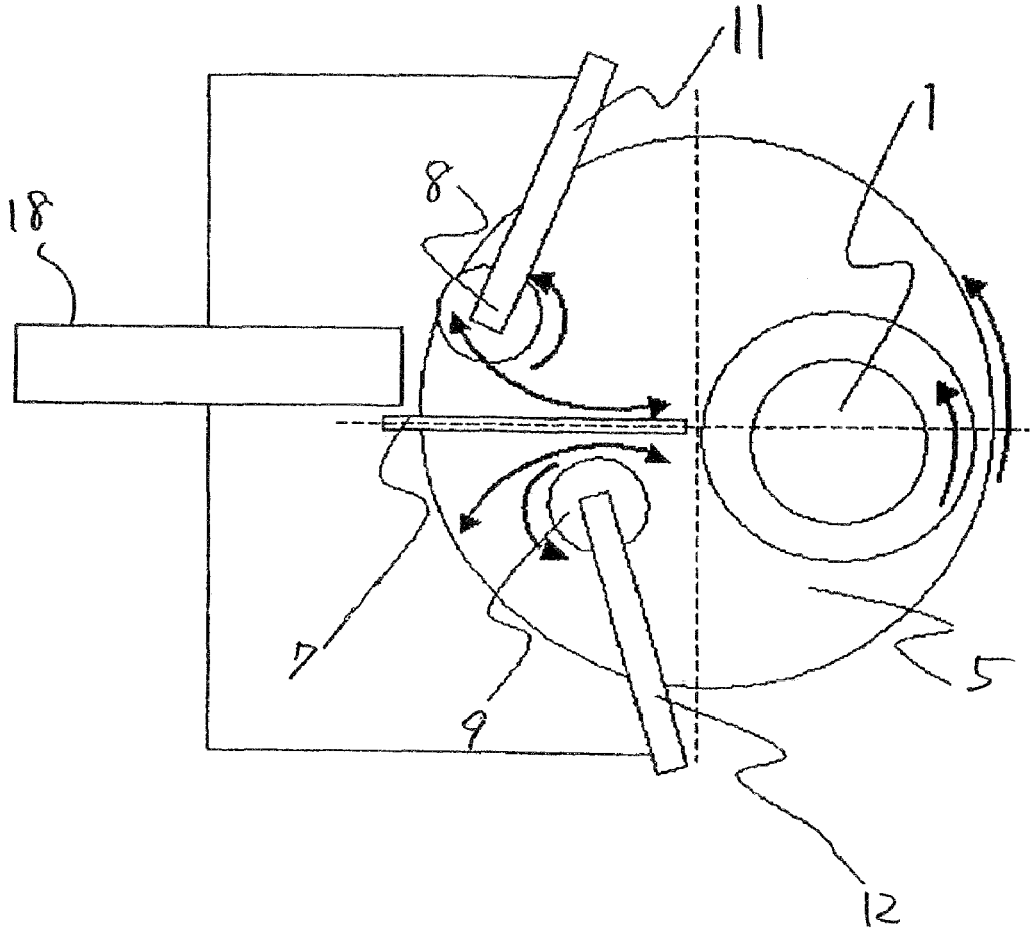
FIG. 8 is a plan view of a dresser arrangement in another exemplary embodiment of the present invention.

FIG. 8 shows a plan view of a dresser arrangement in another exemplary embodiment of the present invention. In this exemplary embodiment, as shown in FIG. 8, first dresser 8 and second dresser 9 in which diamond abrasive grains are fixed to a bottom surface are rotatably supported by dresser oscillating plates 11, 12, respectively. First and second dresser oscillating plates 11, 12 are arranged so that the leading end sides of both are opposite to each other. Dressers 8, 9 are separately moved to two places on polishing pad 5 by dresser oscillating plates 11, 12, respectively, and can be caused to oscillate in two places on polishing pad 5.

It is possible to obtain the same effect as with the dressers shown in FIG. 3 if two dressers 8, 9 are separately arranged in two places on polishing pad 5 like this.

However, in the arrangement of the exemplary embodiment, it is necessary to provide dresser position controller 18 to separately control the respective positions of dressers 8, 9 in order to synchronize the oscillation of separate dressers 8, 9. For example, as shown in FIG. 8, when dresser 8 is caused to oscillate clockwise by first dresser oscillating plate 11, dresser 9 is similarly caused to oscillate clockwise by second dresser oscillating plate 12.

The exemplary embodiments of the present invention were described above on the basis of the drawings. However, the above-described exemplary embodiments can be appropriately changed so long as the changes do not depart from the technical philosophy of the present invention, the changes being not limited to the illustrated construction, for example, the number of dressers or the mechanism of the polishing head portion.

In the above-described exemplary embodiments, descriptions were given of the CMP of interlayer films such as an oxide film. However, the polishing apparatus of the present invention can be applied to all CMP fields including the metal film polishing step adopted in removing unnecessary parts of buried film in the process of forming a metal plug or a metal interconnect (damascene), and it is needless to say that, in particular, the objects to be polished are not limited.

While preferred embodiments of the present invention have been described using specific terms, such description is for illustrative purposes only, and it is to be understood that changes and variations may be made without departing from the spirit or scope of the following claims.

What is claimed is:

1. A polishing apparatus comprising:

a head that holds a semiconductor wafer;

a polishing pad that polishes a surface to be polished of the semiconductor wafer held by the head;

a disk-shaped dresser that reconditions the polishing pad by cutting the polishing pad; and a dresser oscillator that supports at least two said disk-shaped dressers so that the disk-shaped dressers can rotate on their own axes, and that simultaneously oscillates the disk-shaped dressers on the polishing pad, wherein the dresser oscillator separately supports each of the disk-shaped dressers and has a dresser position controller that controls the position of each of the disk-shaped dressers so that oscillations of each of the disk-shaped dressers are in synchronization with each other, and wherein a rotation axis of each of the disk-shaped dressers is rotatably supported in a dresser supporting plate, the dresser supporting plate has another rotation axis that differs from the rotation axis of each of the disk-shaped dressers, and the dresser supporting plate rotates on its own rotation axis.

2. The polishing apparatus according to claim 1, wherein the dresser oscillator has one arm which causes the dresser supporting plate to move onto the polishing pad.

3. A method of reconditioning a polishing pad, the method comprising:

providing a polishing apparatus comprising a polishing pad that polishes a surface, which is to be polished, of a semiconductor wafer and a disk-shaped dresser that reconditions the polishing pad by cutting the polishing pad; and reconditioning the polishing pad by use of the disk-shaped dresser before and after the polishing of the surface to be polished, wherein at least two said disk-shaped dressers are simultaneously moved onto the polishing pad, each of the disk-shaped dressers is caused to rotate on its own axis, and the disk-shaped dressers are caused to oscillate simultaneously on the polishing pad, wherein oscillations of each of the disk-shaped dressers are caused to be in synchronization with each other, and wherein a rotation axis of each of the disk-shaped dressers is rotatably supported in a dresser supporting plate, the dresser supporting plate has another rotation axis that differs from the rotation axis of each of the disk-shaped dressers, and the dresser supporting plate rotates on its own rotation axis.

4. The polishing method according to claim 3, wherein the dresser oscillator has one arm which causes the dresser supporting plate to move onto the polishing pad.

5. A polishing apparatus comprising:

a head that holds a semiconductor wafer;

a polishing pad that rotates and polishes a surface to be polished of the semiconductor wafer held by the head, said head holding the semiconductor wafer against a top surface of the polishing pad;

a disk-shaped dresser downstream of the head in a direction of rotation of the polishing pad that reconditions the polishing pad by cutting the top surface of the polishing pad; and a dresser oscillator that supports at least two said disk-shaped dressers so that the disk-shaped dressers can rotate on their own axes, and that simultaneously reciprocally rotates the disk-shaped dressers on the polishing pad, wherein a rotation axis of each of the disk-shaped dressers is rotatably supported in a dresser supporting plate, the dresser supporting plate has another rotation axis that differs from the rotation axis of each of the disk-shaped dressers, and the dresser supporting plate rotates on its own rotation axis.

6. The polishing apparatus according to claim 5, wherein the dresser oscillator has one arm which causes the dresser supporting plate to move onto the polishing pad.

* * * * *